US010139185B2

(12) United States Patent
Jacobson

(10) Patent No.: US 10,139,185 B2
(45) Date of Patent: Nov. 27, 2018

(54) CALIBER-SPECIFIC CLEANING KIT

(71) Applicant: Revo Brand Group, LLC, Plymouth, MN (US)

(72) Inventor: Ryan Jacobson, Minneapolis, MN (US)

(73) Assignee: Revo Brand Group, LLC, Plymouth, MN (US)

( * ) Notice: Subject to any disclaimer, the term of this patent is extended or adjusted under 35 U.S.C. 154(b) by 0 days.

(21) Appl. No.: 15/380,799

(22) Filed: Dec. 15, 2016

(65) Prior Publication Data

US 2018/0172386 A1 Jun. 21, 2018

(51) Int. Cl.
*F41A 29/02* (2006.01)

(52) U.S. Cl.
CPC ..... *F41A 29/02* (2013.01)

(58) Field of Classification Search
CPC ..... F41A 29/00; F41A 29/02; F41A 29/04
See application file for complete search history.

(56) References Cited

U.S. PATENT DOCUMENTS 882,598 A * 3/1908 Ward ..... F41A 29/02 15/104.066
2,544,847 A * 3/1951 Malesky ..... F41A 29/02 15/104.165
2,545,145 A * 3/1951 Hoyle ..... B65D 85/676 242/118.4
2,749,565 A * 6/1956 Stamm, Jr. ..... F41A 29/02 15/104.165
2,800,289 A * 7/1957 Stamm, Jr. ..... F41A 29/02 15/104.16
2,834,973 A * 5/1958 Friesen ..... F41A 29/02 15/104.165
2,865,071 A * 12/1958 Clemens ..... H02G 11/02 174/135
3,398,417 A * 8/1968 Erwin ..... F41A 29/02 15/104.19
3,430,886 A * 3/1969 Sweeney ..... A01K 89/00 242/118.7

(Continued)

OTHER PUBLICATIONS

Strictly for Kids; Sax Jewelry Cord, 1.5mm x 25 yd, Spool, Assorted Color, Pack of 6; website; https://www.strictlyforkidsstore.com/jewelry-making/sax-jewelry-cord-1.5-mm-x-25-yd-spool-assorted-color-pack-of-6.

(Continued)

*Primary Examiner* — Derrick R Morgan
(74) *Attorney, Agent, or Firm* — Grumbles Law PLLC; Brittany Nanzig

(57) ABSTRACT

A portable, cable-based, caliber-specific cleaning kit having a cable attached on one end to a plurality of cleaning tools and on another end to an ergonomic handle comprised of a reel and cover, the cleaning kit being used for maintenance of gun bores. The cable is stiff enough so that a first end can be fed through a gun barrel and, after exiting the end of the barrel, can attach to the handle at an anchor site on the reel. The plurality of cleaning tools, which are attached to a second end of the cable, can then be pulled through the barrel by the handle and cable combination to clean and remove carbon and residue. After cleaning is complete, a user can wind up and secure the cable and cleaning tools to the handle, and the cover can compactly store the cleaning elements.

33 Claims, 12 Drawing Sheets

(56) References Cited

U.S. PATENT DOCUMENTS 4,200,249 A * 4/1980 Synstelien ..... A01K 97/06 224/255
4,390,142 A * 6/1983 Cheng ..... H02G 11/02 242/388.1
4,399,627 A * 8/1983 Malesky ..... F41A 29/02 15/104.16
4,702,028 A * 10/1987 Dahlitz ..... F42B 14/06 102/532
4,716,673 A 1/1988 Williams et al.
4,776,125 A * 10/1988 Black ..... F41A 29/02 15/104.165
4,802,638 A * 2/1989 Burger ..... B65H 75/143 242/388.1
5,074,074 A * 12/1991 Yeadon ..... F41A 29/02 242/405
5,641,067 A 6/1997 Ellis
5,762,281 A * 6/1998 Foley ..... B65H 75/28 160/178.1 R
5,775,021 A * 7/1998 Weiss ..... F41A 29/02 42/95
5,871,589 A * 2/1999 Hedge ..... F41A 29/02 134/8
5,972,125 A * 10/1999 Hedge ..... F41A 29/02 134/8
5,984,224 A 11/1999 Yang
6,088,866 A 7/2000 Hedge
6,349,893 B1 * 2/2002 Daoud ..... B65H 75/406 242/376
6,554,218 B2 * 4/2003 Buyce ..... B65H 75/143 242/388.6
6,630,034 B1 * 10/2003 Schnell ..... B08B 9/045 134/132
6,701,658 B1 * 3/2004 Brownell ..... F41A 29/02 15/104.16
6,966,791 B1 * 11/2005 Farr ..... B65H 75/406 206/303
7,216,665 B1 * 5/2007 Sims, Jr. ..... A61M 39/08 137/355.19
7,229,042 B2 * 6/2007 Thebault ..... G02B 6/4457 242/388.1
D620,781 S * 8/2010 Weckworth ..... D8/356
8,091,820 B2 * 1/2012 Thorn ..... B65H 75/143 242/388.1
8,146,284 B2 4/2012 Smith
D688,252 S * 8/2013 Paul ..... D14/205
8,500,054 B2 * 8/2013 Grant ..... A61M 5/1418 242/129.2
8,572,883 B2 * 11/2013 Markle ..... F41A 29/02 15/104.062
8,800,191 B2 * 8/2014 Williams ..... F41A 29/02 15/104.2
8,925,235 B2 * 1/2015 Buie, II ..... F41A 29/02 42/90
9,115,945 B2 * 8/2015 Williams ..... F41A 29/02
9,228,790 B2 1/2016 Stephens
9,813,797 B2 * 11/2017 Abfall ..... H04R 1/1033
2002/0145073 A1 * 10/2002 Swanson ..... A61F 15/002 242/588.3
2003/0122021 A1 * 7/2003 McConnell ..... A61M 39/08 242/388.1
2004/0111948 A1 6/2004 Schnell
2006/0196989 A1 * 9/2006 Bartley ..... B65H 49/08 242/601
2007/0251786 A1 * 11/2007 Wegner ..... B65H 75/28 191/12.2 R
2008/0035778 A1 * 2/2008 Belden ..... A45F 5/004 242/375
2008/0156916 A1 * 7/2008 DeLuca ..... B65H 49/322 242/171
2011/0016649 A1 1/2011 Reggio et al.
2017/0258214 A1 * 9/2017 Borsari ..... A46B 3/18

OTHER PUBLICATIONS

Hoppe's; BoreSnake; website; http://www.hoppes.com/guick-clean/the-boresnake.
Sage & Braker; Bore Cleaning Kits; website; http://www.sageandbraker.com/shop/rifle-bore-cleaning-kit.
Quirky; PowerCurl V2 85W Cord Wrap; website; http://www.bestbuy.com/site/guirky-powercurl-v2-85w-cord-wrap/3856059.p?skuId=3856059.
Otis; Ripcord; website; http://www.otistec.com/ripcord/.
Proclip USA Inc.; Quiddies Flipreel; http://www.sguiddiesflipreel.com/.

* cited by examiner

CALIBER-SPECIFIC CLEANING KIT

FIELD OF THE INVENTION

This disclosure relates to a portable kit used for firearm cleaning. More specifically, it relates to a portable, cable-based, caliber-specific cleaning kit having a cable, which can be attached on one end to a handle and on another end to a plurality of cleaning tools, the cleaning kit being used during maintenance of gun bores.

BACKGROUND OF THE INVENTION

After use and throughout their lives, gun bores are affected by debris, moisture, rust, copper, carbon, and gunpowder residue. Therefore, gun bores need to be cleaned so they can function properly and so they do not rust and decay. Further, cleaning must occasionally occur while the user is on the go. To accomplish this, individuals must be able to access the inside surface of a gun bore and any carbon or residue therein. However, storage and use of existing bore cleaners is not ideal.

Some cleaning tools are flexible so they can be fed into the gun bore through an opening in the chamber, but this flexibility means they are difficult to move around once inside the gun bore. Additionally, most existing bore cleaners do not provide their own storage options. After use, the cleaner is usually covered with carbon and residue and, if the user stores the bore cleaner with other tools, the user is at risk of the carbon and residue transferring to other clean tools. Further, the flexible cord of the bore cleaner can easily get tangled in other items. Therefore, a new bore cleaner is needed that is portable, includes several cleaning components, and provides its own storage compartment.

SUMMARY OF THE INVENTION

The present disclosure relates to a portable, cable-based, caliber-specific cleaning kit allowing a cable to attach on one end to an ergonomic handle and on another end to a plurality of cleaning tools, the cleaning kit being used during maintenance of gun bores. The cable is stiff enough so that a first end can be fed through a gun barrel and, after exiting the end of the barrel, can attach to the handle. The plurality of cleaning tools, which are attached to a second end of the cable, can then be pulled through the barrel by the handle and cable combination to clean and remove carbon and residue. After cleaning is complete, a user can wind up and secure the cable and cleaning tools to the handle, which has a cover and can compactly store the cleaning elements.

DETAILED DESCRIPTION

Figure 1:
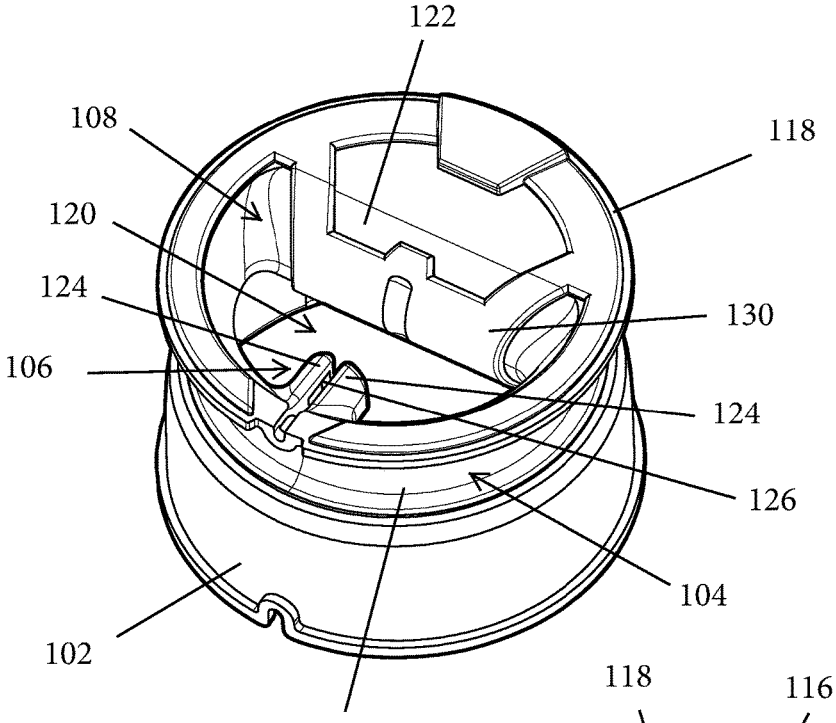
FIG. 1 is a perspective top view of a caliber-specific cleaning kit according to one embodiment of the present disclosure.

The present disclosure relates to a caliber-specific cleaning kit that is used to clean the interior barrel (i.e., the bore) of a gun. Various embodiments of the caliber-specific cleaning kit will be described in detail with reference to the drawings, wherein like reference numerals represent like parts and assemblies throughout the several views. Reference to various embodiments does not limit the scope of the caliber-specific cleaning kit disclosed herein. Additionally, any examples set forth in this specification are not intended to be limiting and merely set forth some of the many possible embodiments for the caliber-specific cleaning kit. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Some embodiments of the caliber-specific cleaning kit disclosed herein include features that are best suited for cleaning the interior surfaces of a gun barrel, otherwise known as the bore of a gun. Most modern rifle and pistol bores have rifling, wherein the bore is comprised of lands and grooves. The grooves are cutout, helical spaces that extend down the bore. The lands are the ridges in between the grooves. The modular configuration of the caliber-specific cleaning kit allows the device to operate as storage and cleaning tool for specific calibers of guns, and the combination of cleaning tools enables both grooves and lands to be cleaned simultaneously.

More specifically, the caliber-specific cleaning kit is a portable, cable-based, caliber-specific cleaning kit having a cable attachable on a first end to an ergonomic handle and on a second end to a plurality of cleaning tools. The cable is stiff enough so that a first end can be fed through a gun bore and thereafter attached to an ergonomic handle that a user can grab and pull. The user can, therefore, pull on the handle that is attached to the first end of the cable, and the cleaning tools, which are attached to the second end of the cable, can then be pulled through the bore to remove carbon and residue. After cleaning is complete, a user can also use the caliber-specific cleaning kit as a storage unit. For example, the user can wind up and secure the cable and cleaning tools to the reel of the handle, wherein the handle may also have a cover to conceal the cable and the cleaning tools and can compactly store the cable and the cleaning tools.

Figure 2:
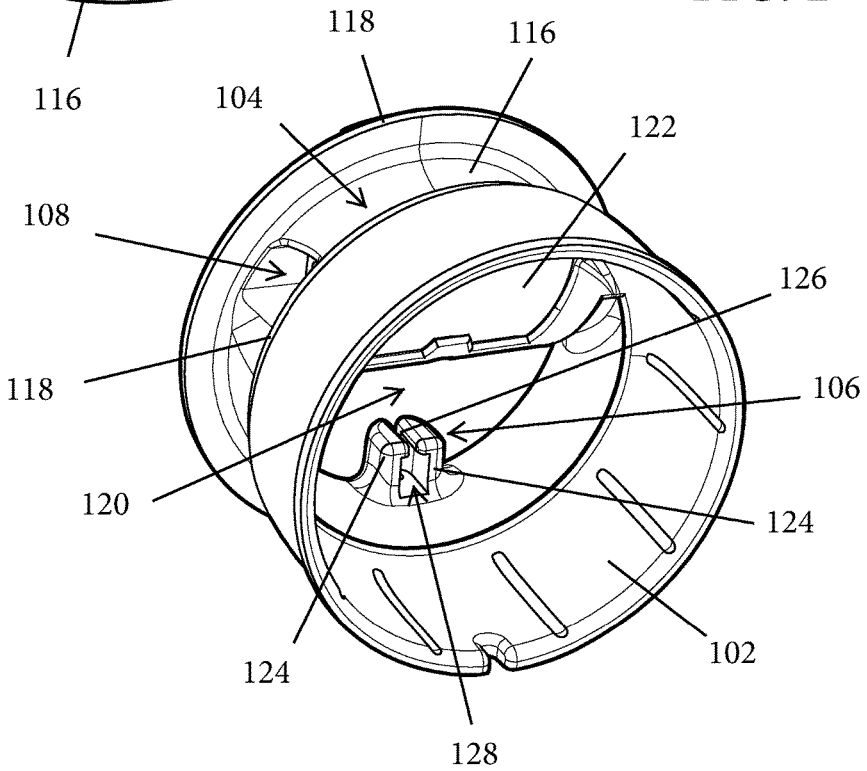
FIG. 2 is a perspective bottom view of a caliber-specific cleaning kit according to one embodiment of the present disclosure.
Figure 3:
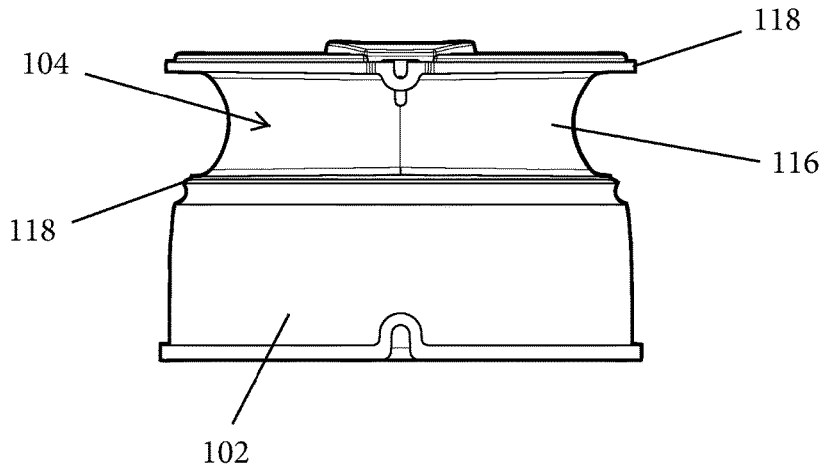
FIG. 3 is a front elevational view of a caliber-specific cleaning kit according to one embodiment of the present disclosure.
Figure 4:
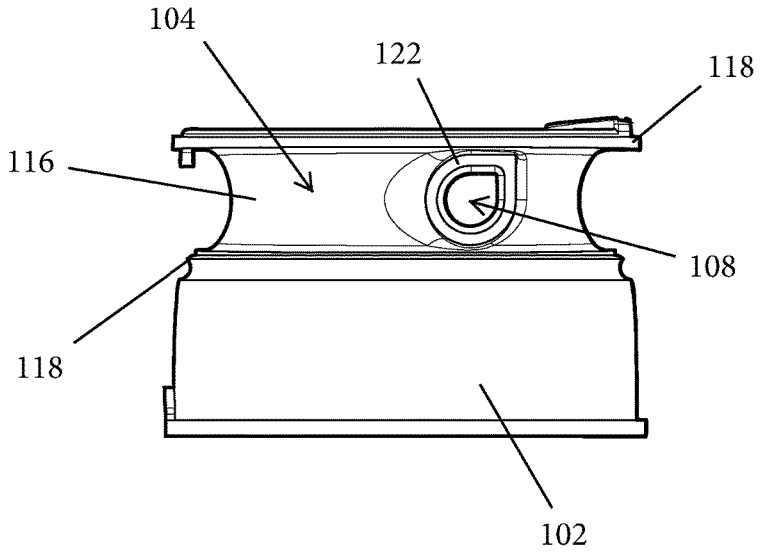
FIG. 4 is a right side elevational view of a caliber-specific cleaning kit according to one embodiment of the present disclosure.
Figure 5:
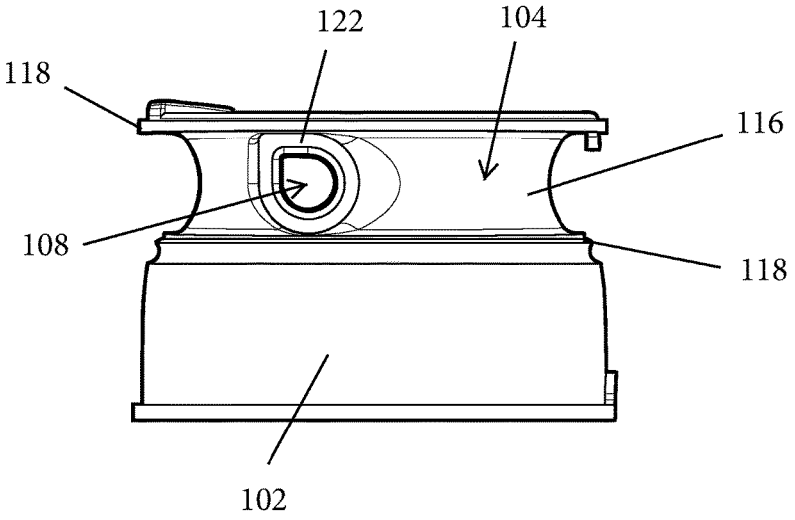
FIG. 5 is a left side elevational view of a caliber-specific cleaning kit according to one embodiment of the present disclosure.
Figure 6:
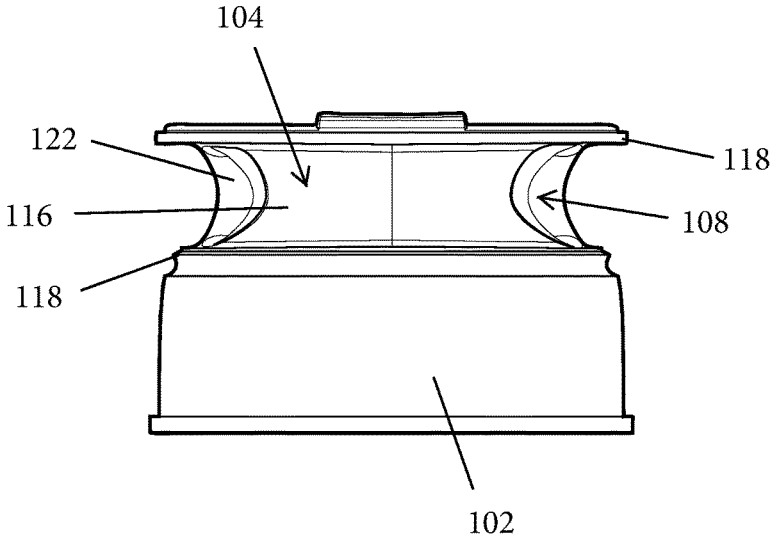
FIG. 6 is a back elevational view of a caliber-specific cleaning kit according to one embodiment of the present disclosure.
Figure 7:
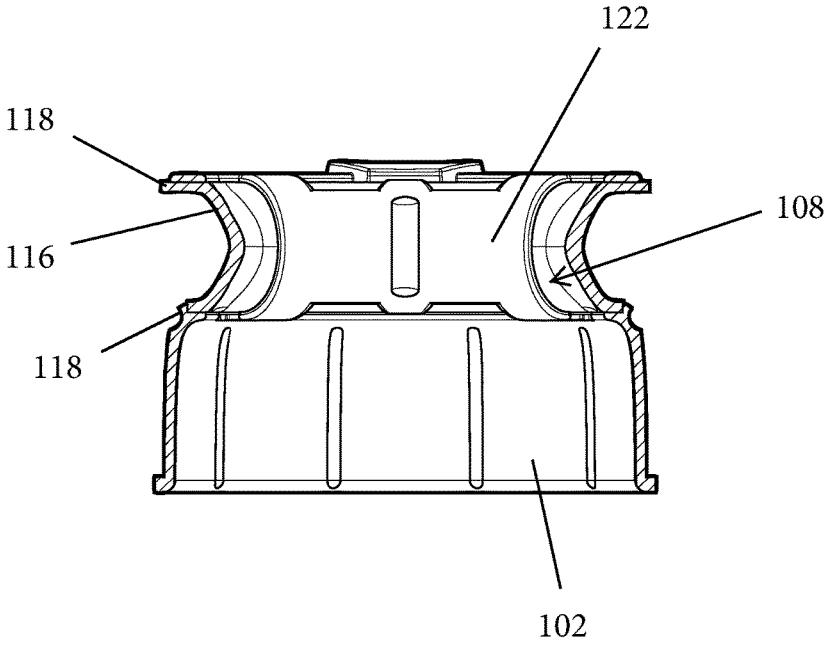
FIG. 7 is a cross-section front view taken from the line 7-7 in FIG. 9 of a caliber-specific cleaning kit according to one embodiment of the present disclosure.
Figure 8:
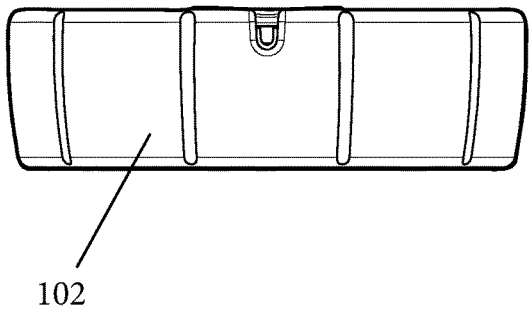
FIG. 8 is a front elevational view of a caliber-specific cleaning kit in its closed position according to one embodiment of the present disclosure.
Figure 9:
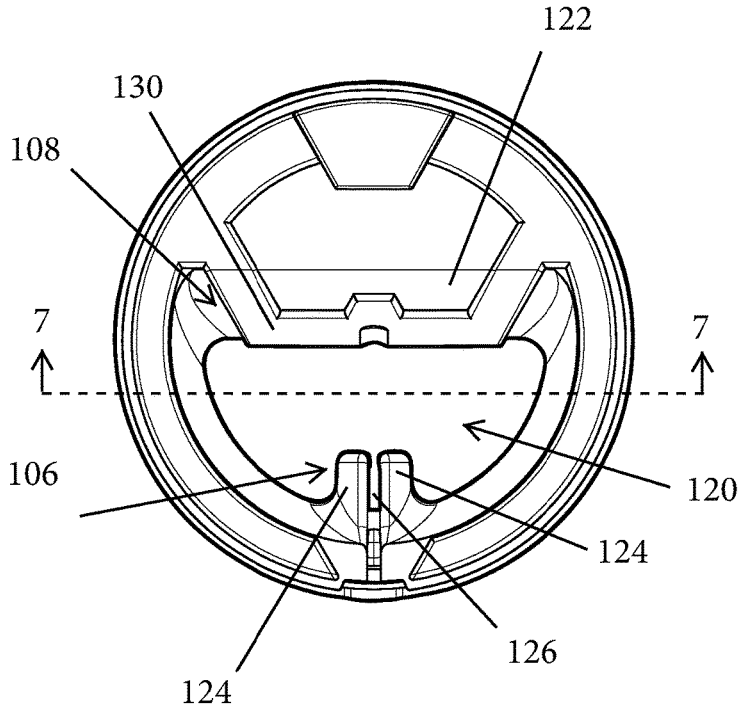
FIG. 9 is a top view of a caliber-specific cleaning kit according to one embodiment of the present disclosure.
Figure 10:
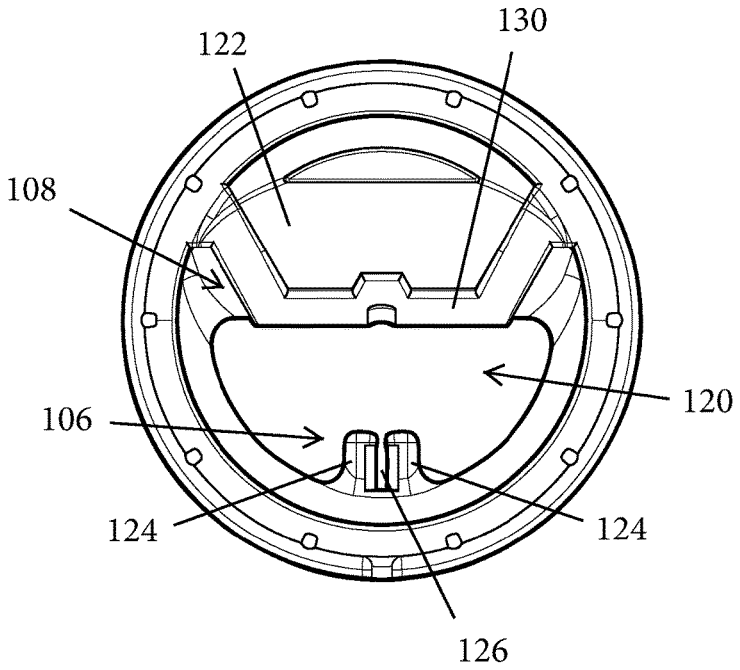
FIG. 10 is a bottom view of a caliber-specific cleaning kit according to one embodiment of the present disclosure.
Figure 11:
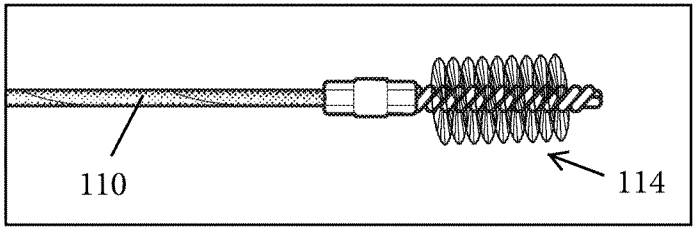
FIG. 11 illustrates a cleaning implement used in various embodiments of a caliber-specific cleaning kit.

FIGS. 1-10 illustrate various views of an example of a caliber-specific cleaning kit according to the present disclosure. FIG. 1 is a top perspective view. FIG. 2 is a bottom perspective view. FIG. 3 is a front elevational view. FIG. 4 is a right side elevational view. FIG. 5 is a left side elevational view. FIG. 6 is a back elevational view. FIG. 7 is a cross-section front elevational view. FIG. 8 is a front view of the device in a closed configuration. FIG. 9 is a top view. FIG. 10 is a bottom view. FIGS. 11-15 illustrate the various cleaning tools that can be used to scrape or rub against the bore. FIGS. 16-21 illustrate various steps taken when using the caliber-specific cleaning kit.

Figure 15:
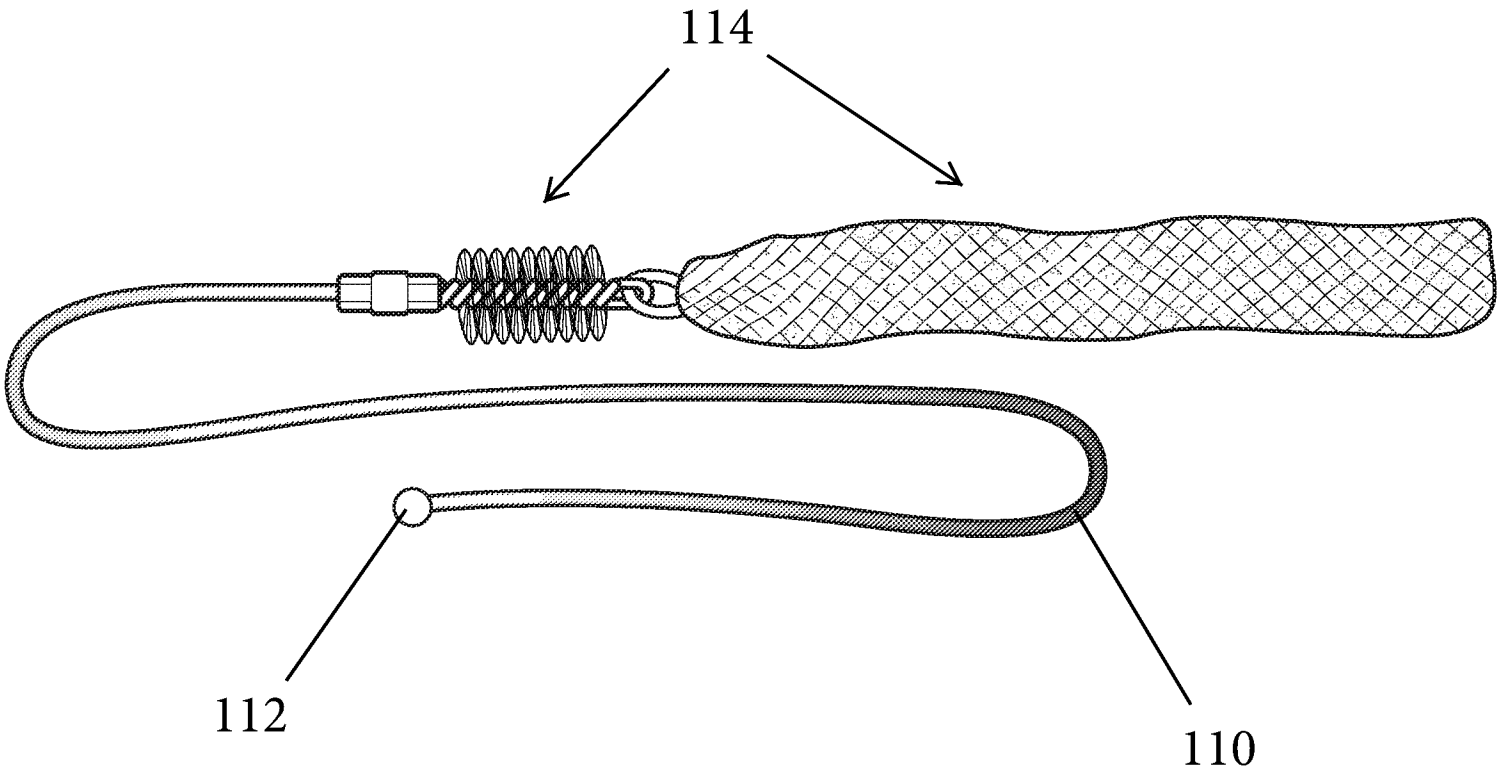
FIG. 15 illustrates an anchor, cable, and plurality of cleaning implements used in one embodiment of a caliber-specific cleaning kit.
Figure 21:
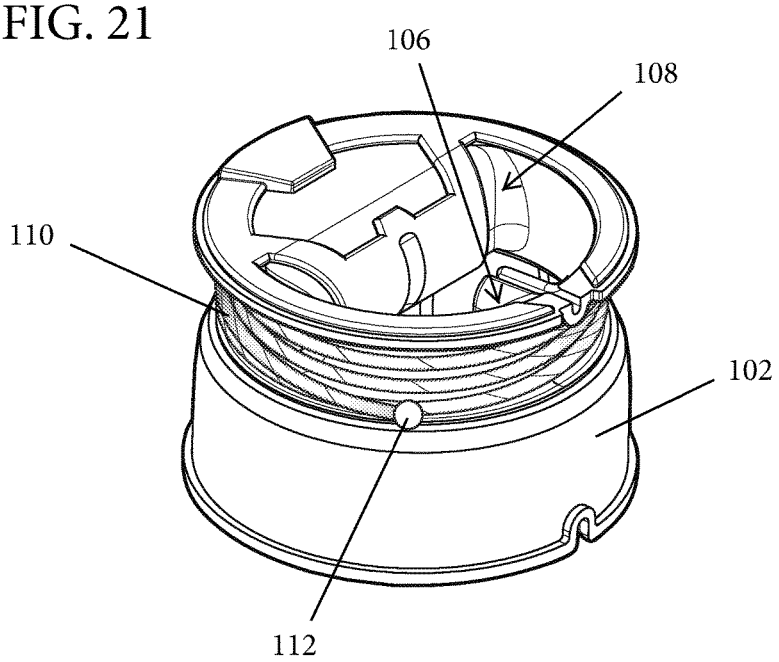
FIG. 21 illustrates the cleaning implements wrapped around a reel of a caliber-specific cleaning kit according to one embodiment of the present disclosure.

Generally, in a closed configuration, the caliber-specific cleaning kit is roughly cylindrical with a relatively short height compared to its diameter. In a preferred embodiment, as illustrated in FIGS. 1, 15, and 21, the caliber-specific cleaning kit is comprised of an ergonomic handle comprised of a flexible cover 102 and a reel 104, wherein the reel 104 has an anchor site 106 and a storage compartment, region, or cavity 108; a tether or cable 110; an anchor 112; and a cleaning tool 114. The flexible cover 102 is also roughly cylindrical and fits around or encases an outside circumference of the reel 104, which is a similar height as the flexible cover 102. The handle's reel 104 preferably has a first internal cavity that is a hollow center cavity 120, and the anchor site 106 is preferably located on an inner surface of the reel 104 and leads from the hollow center cavity 120 to the external surface of the reel 104. Additionally, the reel 104 may have an additional cavity that is a storage cavity 108 located adjacent to the hollow center cavity 120 and across from the anchor site 106 and that is in an inner extension 122 of the reel 104.

The flexible cover 102 can be made of any flexible material. For example, it can be made of silicone or a thermoplastic elastomer (TPE). However, preferably, the durometer of the flexible cover 102 ranges between 30 and 50 with the specific durometer dependent on the flexible material comprising the flexible cover 102. In some embodiments, the flexible cover 102 has a top edge and a bottom edge, is roughly tire shaped or the shape of a ring, is fixedly attached to the reel 104 along one of its edges, and is configured to move between a first position and a second position relative to the reel.

The free edge of the flexible cover 102 enables the flexible cover 102 to flip inside out so that the flexible cover 102 is effectively inverted, as illustrated in FIGS. 1-7. More specifically, in the closed configuration, illustrated in FIGS. 8-10, the flexible cover 102 covers the reel 104 by being positioned over the reel 104 and encompassing the circumference of the reel 104. One edge is fixedly attached to the top or bottom edge of the reel 104 and a second, free edge is approximately aligned with the opposite edge of the reel 104. For example, the fixed edge of the flexible clover 102 can attach along the bottom edge of the reel 104 and the free edge of the flexible cover 102 can align with the top edge and face of the reel 104. To transition the caliber-specific cleaning kit to an open configuration, the flexible cover 102 can be flipped inside out, thereby exposing the reel 104 and other components of the caliber-specific cleaning kit.

In some embodiments, instead of a flexible cover 102, the cover may be rigid. Therefore, to move between the first position and the second position in relation to the reel to expose the cable 110, anchor 112, and cleaning tool 114, the cover may, instead of flipping inside out, twist around and upward to expose the reel 104 or it may removably snap onto and off of the reel 104. Alternatively, the cover, in its flexible or rigid form, may have an interference fit with the reel 104 and, therefore, can securely confine the reel 104. When a user would like to expose the cable 110, anchor 112, and cleaning tool 114, the user can simply pull the cover off.

In the closed configuration, the flexible cover 102 can, in addition to encasing the various components of the caliber-specific cleaning kit, such as the reel 104 and cleaning tool 114, provide a comfortable grip point for a user when the flexible cover 102 and reel 104 are used as a handle. However, in some embodiments, the flexible cover 102 is not included in the cleaning kit.

The reel 104 of the handle, as mentioned above, can be made of a rigid material, such as acrylonitrile-butadiene-styrene (ABS), polycarbonate, or other thermoplastic polymers or plastics. However, the reel 104 does not have to be rigid; it can be made of a flexible material. The reel 104 can be any shape. However, in a preferred embodiment, the reel 104 is cylindrical, is roughly the same height as the flexible cover 102, has a hollow center cavity 120, and has a groove 116 with upper and lower lips 118 around the outer perimeter, as illustrated in FIGS. 3-7, the groove providing a surface around which the cable 110, anchor 112, and cleaning tool 114 can wrap when stored. Additionally, a portion, or all, of the reel 104 can be clear. This enables an individual to see the cable 110, anchor 112, and cleaning tool 114 when they are stored away.

In a preferred embodiment, the reel 104 also has a hollow storage cavity 108 that is an inner extension 122 of the reel 104. More specifically, the back portion of the reel 104 can extend into the hollow center cavity 120, as illustrated in FIGS. 1-2 and 9-10, and can contain a cylindrical storage cavity 108, illustrated in FIGS. 4-5, in which the cleaning tool 114 can be inserted when the caliber-specific cleaning kit is in its closed configuration. The inner extension 122 can contain a grip 130 that approximately bisects the hollow center cavity 120 or it can, alternatively, be a grip that approximately bisects the hollow center cavity 120 but does not contain the cylindrical storage cavity 108. The storage cavity 108 can have a window or can be clear, which enables a user to view the cleaning tool 114 stored inside the caliber-specific cleaning kit.

In some embodiments, one or more inserts of varying diameters can be placed into the storage cavity 108 to reduce the storage cavity's diameter. The external diameter of the storage cavity 108 therefore stays the same, but the internal diameter changes. With an insert, the storage cavity 108 may be able to snuggly enclose a cleaning tool 114 of any shape and size. Preferably, the external shape of the insert conforms to the internal shape of the storage cavity 108 in a unique arrangement, which enables the insert to fit into the storage cavity 108 in one direction. The fit of the insert inside the storage cavity 108, in some embodiments, can be a pressure fit.

Figure 18:
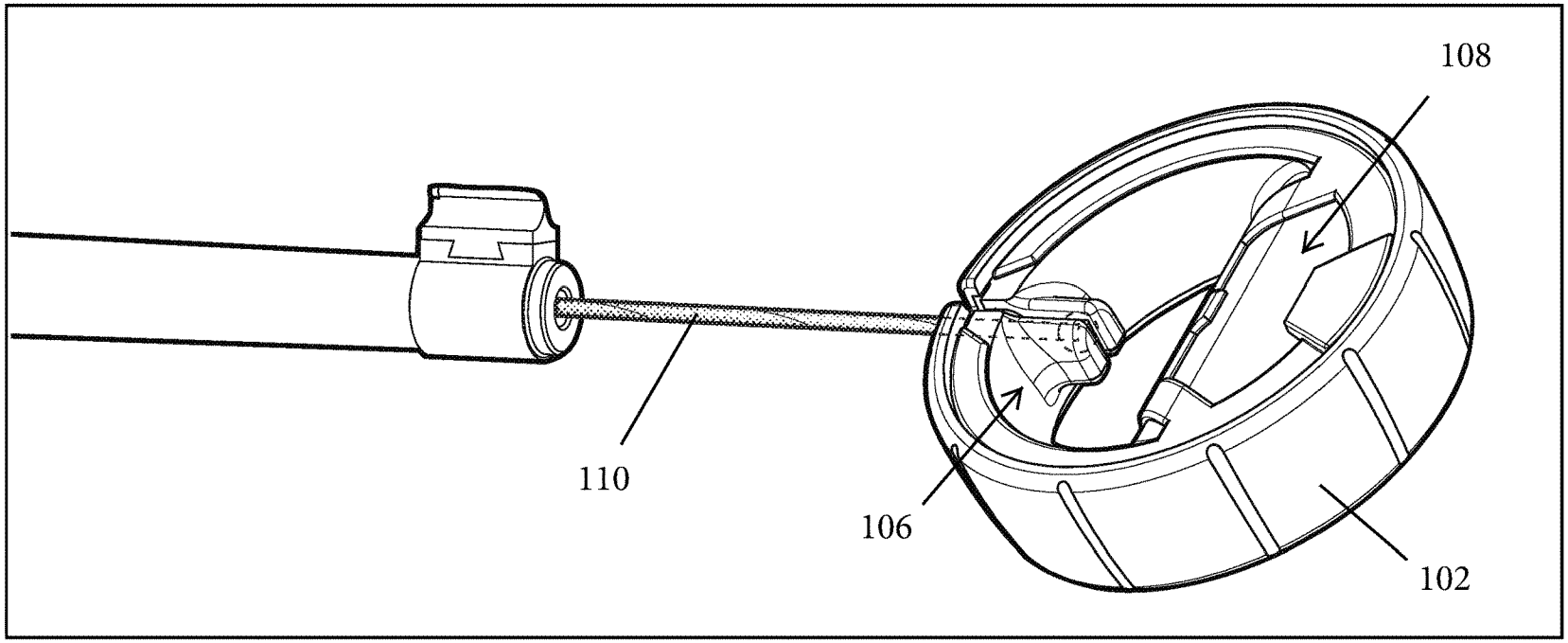
FIG. 18 illustrates a caliber-specific cleaning kit in use according to one embodiment of the present disclosure.

In some embodiments, the reel 104 has an anchor site 106 located on its inner surface across from the storage cavity 108, as illustrated in FIGS. 1-2 and 9-10. The anchor site 106 can have an entrance that protrudes slightly from the inner surface of the reel 104 and is designed to catch the anchor 112, which is attached to end of the cable 110, as illustrated in FIG. 15. The inner portion of the protruding entrance to anchor site 106 can have walls 124, which enable the anchor 112 to nest within the anchor site 106, as illustrated in FIG. 18. The main body of the anchor site 106, which continues through the reel 104, contains a notch 126 that is open to the bottom face of the reel 104, the bottom face of the protruding entrance, and the back face of the protruding entrance, as illustrated in FIGS. 1 and 2 respectively, and through which the cable 110 can pass. The notch 126 exits out of the front of the reel 104 through an external surface of the reel 104, as illustrated in FIG. 1. This path, therefore, is broader than the cable 110, yet narrower than the anchor 112. As illustrated in FIG. 2, the top face of the entrance of the anchor site 106 has an anchor opening 128 that can accept the anchor 112.

In use, an individual can quickly connect the cable 110 to the handle by inserting a portion of the cable 110 through the notch 126 of the anchor site 106 with the anchor 112 located underneath the anchor opening 128 of the anchor site 106. The individual can then pull the cable 110 through the anchor site 106 until the anchor 112 reaches the anchor site 106 and is secured to or within the walls 124 of the protruding anchor site 106. Once the anchor 112 is secured, the flexible cover 102 and reel 104, in the closed configuration, can act as an ergonomic grip or handle for the caliber-specific cleaning kit, as illustrated in FIG. 18.

As mentioned above, some embodiments of the caliber-specific cleaning kit have a cable 110, an anchor 112, and a cleaning tool 114. The cable 110 is preferably a 1.5 mm coated cable (for example, a plastic coated steel cable) that is longer than the gun bore. Further, the cable 110 is preferably stiff so that it can be fed horizontally through the gun bore. The anchor 112 also preferably has some rigidity to it so the user can push it through the bore instead of relying on gravity. In a preferred embodiment, the anchor 112 is round, such as a spherical ball, so that it does not scratch the bore. However, the anchor 112 can take any shape. This enables someone to efficiently insert the cable 110 into the chamber, through the bore, and out through the barrel's crown.

On the first end of the cable 110, an attached anchor 112 exists that, after being pushed or "fed" through the bore, can be secured to the anchor site 106, as described above and illustrated in FIG. 18. The other end of the cable 110 can be attached to the cleaning tool 114. The anchor 112 can be a crimped or insert molded, metal or plastic piece that is secured to the first end of the cable 110, or it can be any other rigid or semi-rigid piece that is wider than the cable 110 and the notch 126 of the anchor site 106, yet smaller than the bore. In a preferred embodiment, the anchor 112 is a rigid ball, such as, but not limited to, a cast ball. Therefore, the anchor 112 attached to the anchor site 106 is a cast ball secured at the base of a cup-shaped opening having a channel that continues outward from the base. The cast ball can slide in to the anchor site 106 and, in some embodiments, does not lock to the anchor site 106 but rests inside of it.

Figure 12:
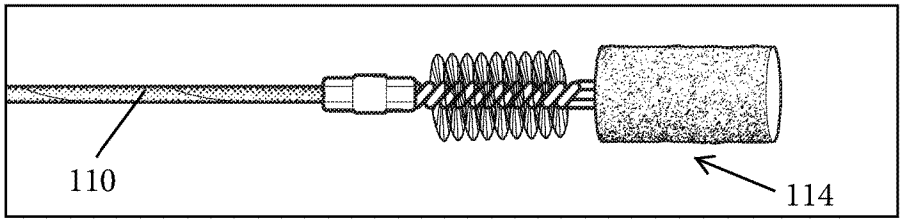
FIG. 12 illustrates a plurality of cleaning implements used in various embodiments of a caliber-specific cleaning kit.
Figure 13:
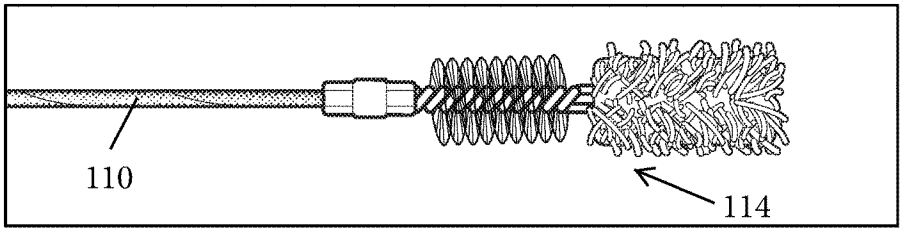
FIG. 13 illustrates a plurality of cleaning implements used in various embodiments of a caliber-specific cleaning kit.
Figure 14:
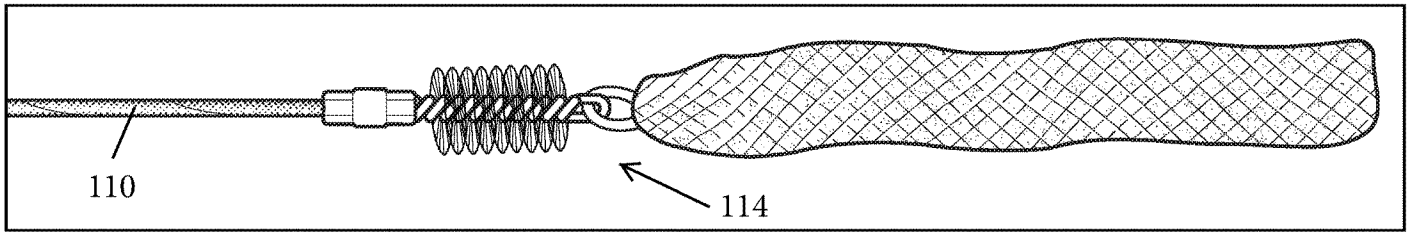
FIG. 14 illustrates a plurality of cleaning implements used in various embodiments of a caliber-specific cleaning kit.

In some embodiments, the cleaning tool 114 is comprised of cleaning implements, as illustrated in FIGS. 11-14. Preferably the cleaning tool 114 is comprised of a plurality of cleaning implements, however it may only contain a single cleaning implement. For example, the cleaning tool 114 may include a brush and a woven bore cleaner arranged in line with each other and the cable, as illustrated in FIGS. 14-15, a brush and a traditional mop arranged in line with each other and the cable, as illustrated in FIG. 13, a brush and a thick felt mop arranged in line with each other and the cable, as illustrated in FIG. 12, or a brush and a wool mop arranged in line with each other and the cable. The brush can be, for example, a 50 mm long brush and may be flexible or rigid. Further, the brush may be made of nylon bristles, of bronze phosphor bristles, or of a combination of nylon and bronze phosphor bristles (for example, interspersed nylon and bronze phosphor bristles). The woven bore cleaner can be any size but, in some embodiments, is a 100-220 mm long woven bore cleaner. The length of the woven bore cleaner can depend on the size of the woven bore cleaner and circumference of the reel 104. More specifically, the length of the woven bore cleaner can equate to one revolution of the reel 104. In some embodiments, the traditional and the thick felt mops can both have any length. In some embodiments, the woven bore cleaner is braided and made of polyester, cotton, or some combination of the materials. Further, the woven bore cleaner can having internal stitching to prevent it from stretching when it is pulled through the gun bore.

Figure 16:
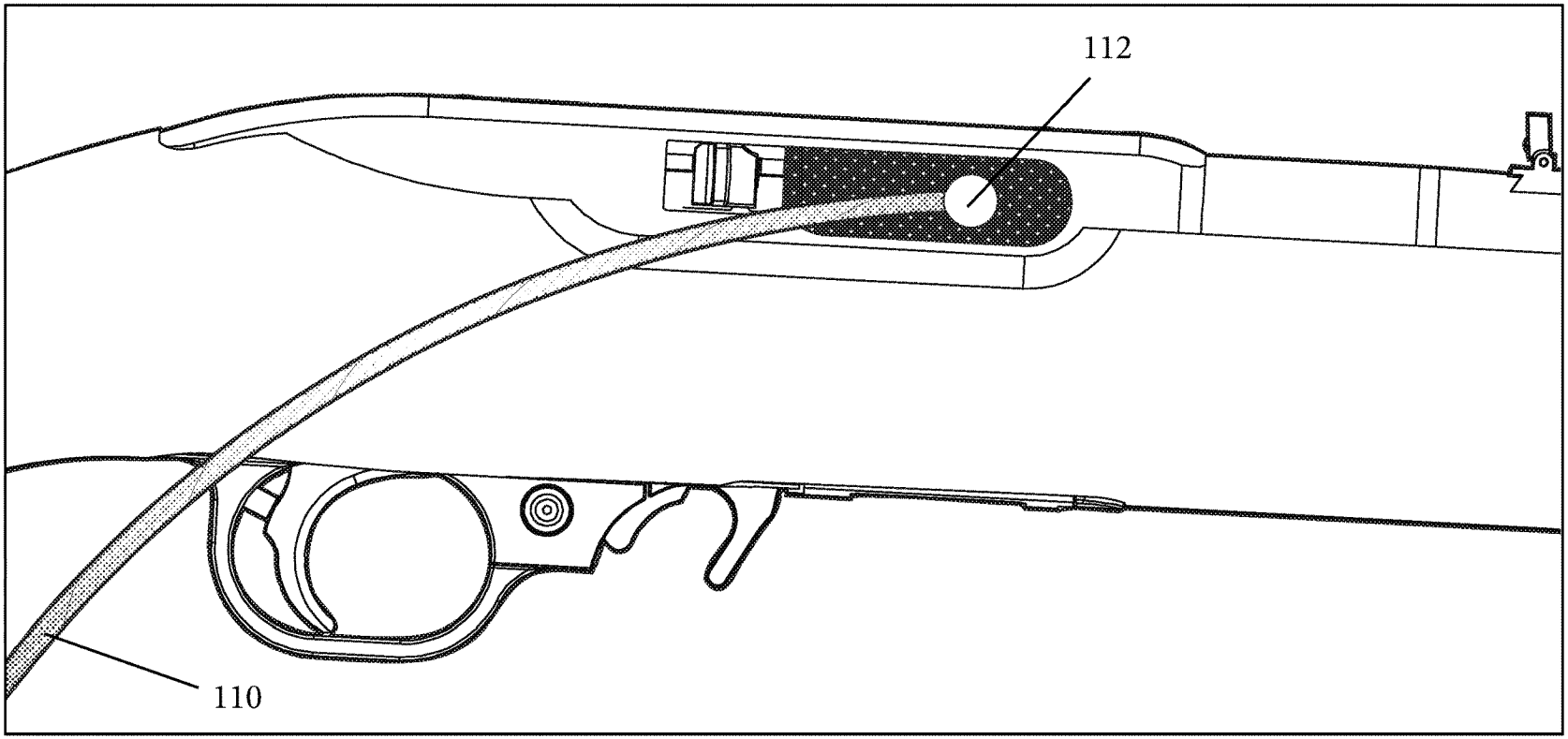
FIG. 16 illustrates a caliber-specific cleaning kit in use according to one embodiment of the present disclosure.
Figure 17:
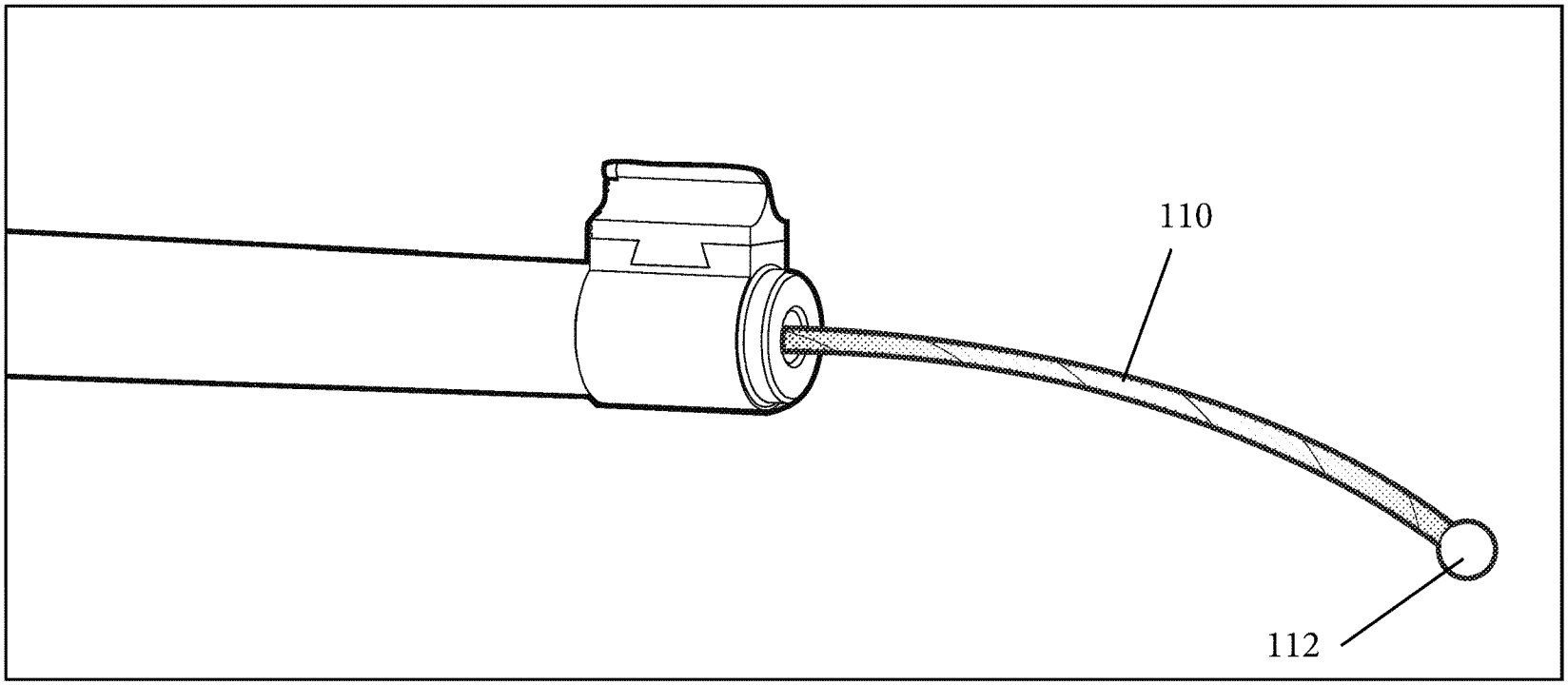
FIG. 17 illustrates a caliber-specific cleaning kit in use according to one embodiment of the present disclosure.
Figure 19:
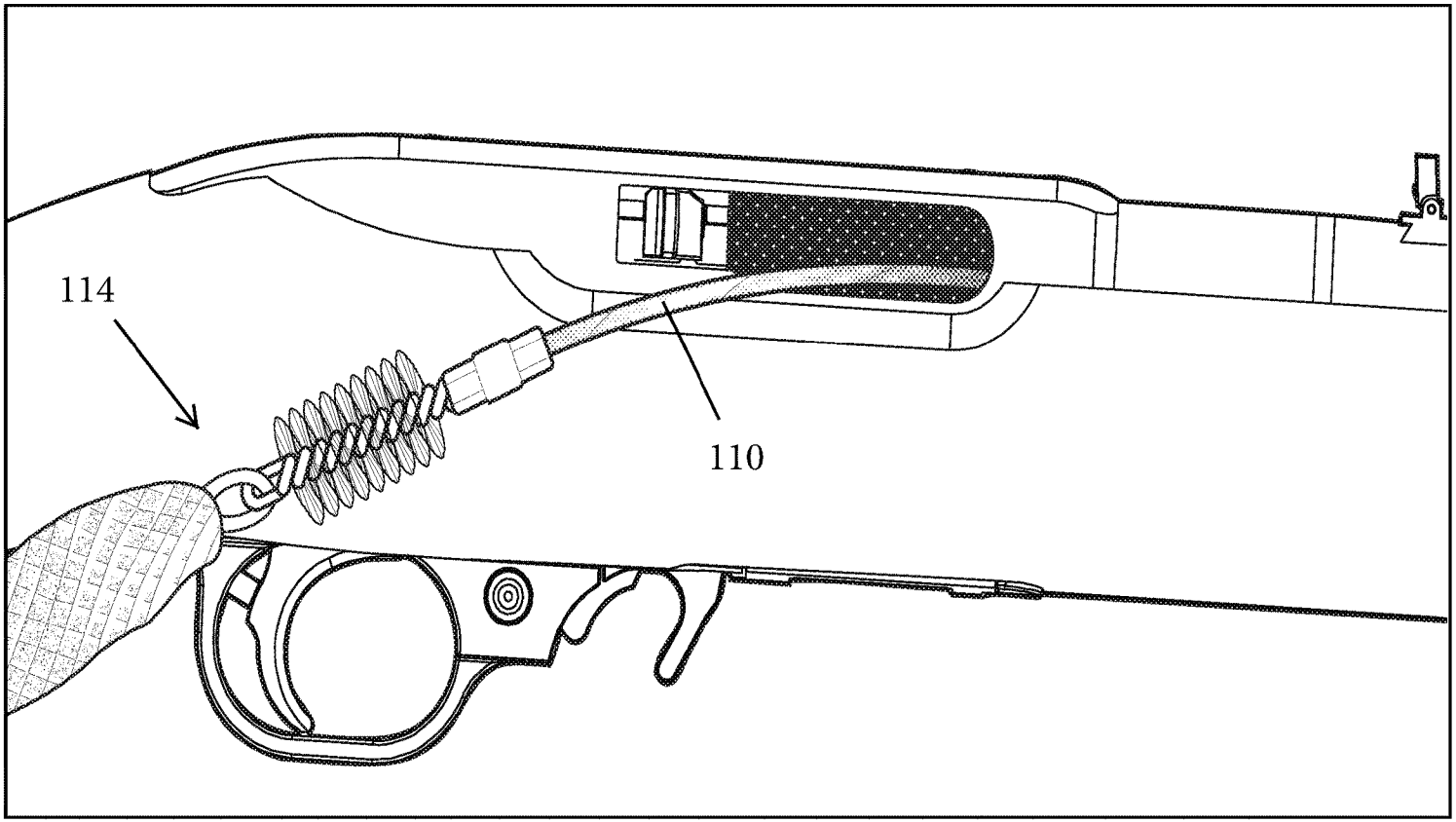
FIG. 19 illustrates a caliber-specific cleaning kit in use according to one embodiment of the present disclosure.
Figure 20:
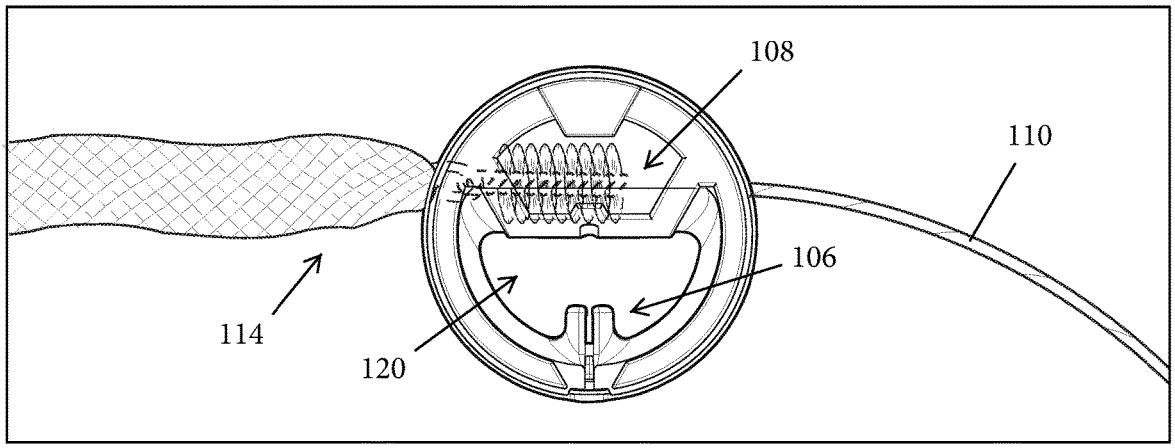
FIG. 20 illustrates connection points of the cleaning implements to the housing of a caliber-specific cleaning kit according to one embodiment of the present disclosure.

While any variety of cleaning implements may be used, the order of the cleaning implements is important. For example, carbon and other residue typically need to be scraped off the surface of the bore and out of the rifling grooves before they can be wiped away from the surface on which they were coated. Therefore, in one embodiment, the cable is attached to a brush (for example, a 50 mm long brush), which is then attached to a woven bore cleaner (for example, a 100-220 mm long woven bore cleaner), as illustrated in FIG. 15. When an individual pushes or "feeds" the cable 110 through the bore, as illustrated in FIGS. 16-17, attaches the anchor 112 to the anchor site 106, as described above and illustrated in FIG. 18, and pulls the cleaning tool 114 through the bore using the handle, as illustrated in FIG. 19, the brush will first scrape loose carbon and residue from the lands and grooves, and the woven bore cleaner will next wipe the surface of the bore clean by dragging the loose carbon and residue along with it through the end of the bore. When a brush and woven bore cleaner are used as the cleaning implements and need to be stored, the brush, due to its rigidity, can be stored in the storage cavity 108, as illustrated in FIG. 20, and the woven bore cleaner can be wrapped around the reel 104 along with the cable 110, as illustrated in FIG. 21.

In some embodiments, the diameter of the cleaning tool 114, such as the brush and woven bore cleaner, may be designed for a single caliber barrel. For example, the cleaning tool 114 may be designed for a .22 handgun; a .22 rifle; a .223 or 5.56 rifle; a .240, .243, .244, or 6 mm rifle; a .270, .280, or 7 mm rifle; a .30, .308, or 9 mm handgun; a .40 or .41 handgun; a .44 or .45 handgun; a 20-gauge shotgun; or a 12-gauge shotgun. However, the cleaning tool 114 is not limited to these calibers. It may be any size and may be designed for any caliber barrel.

In some embodiments, the anchor site 106 and the anchor 112 are the same size regardless of the size of the cleaning tool 114 attached to the cable 110 and anchor 112. This enables the flexible cover 102 and the reel 104 to be interchangeable as pull handles even if they are not interchangeable as storage units. Therefore, if two embodiments exist, for example a .22 rifle embodiment and a 9 mm handgun embodiment, a user can use the same handle while switching out the cable 110, anchor 112, and cleaning tool 114 combinations for each.

In some embodiments where several variations in size exist, a caliber marking can be printed on the reel 104 to ensure an individual knows the type of firearm for which the cleaning tool is appropriate. Further, in embodiments where at least a portion of the reel 104 is clear, the caliber marking can be located on the clear portion.

The design of the cleaning tool 114 is such that the cleaning implements, in some embodiments, are directly connected to one another. More specifically, as described above, the parts of the caliber-specific cleaning kit that are independent of the flexible cover 102 and reel 104 combination can be attached as follows. The first end of the cable 110 can be attached to the anchor 112, and the second end of the cable 110 can be directly attached to the first cleaning implement, such as the brush, which can directly attach to a second cleaning implement, such as a woven bore cleaner, mop, etc.

In an alternative embodiment, the cleaning implements can rotate independently of the cable 110. For example, the first end of the cable 110 can be attached to the anchor 112 and the second end of the cable 110 can be attached to a swivel, which can attach to the cable 110 by being crimped onto the second end of the cable 110. This attachment can be permanent or replaceable. The swivel can then attach to the first cleaning implement, such as the brush, which can directly attach to a second cleaning implement, such as a woven bore cleaner or mop. In some embodiments, the first cleaning implement can attach to the second cleaning element via a second swivel. This would enable both cleaning elements to rotate independently of each other and the cable 110. Any number of cleaning implements can be attached together directly, via swivel, or any combination of direct and swivel connections.

One example of a use case is as follows: a user flips the flexible cover 102 down, thereby exposing the cable 110 that is wrapped around the reel 104, as illustrated in FIG. 21. The user then unravels the cable 110 from the reel 104 and extracts the cleaning tool 114 from its location in the storage cavity 108. Next, the user flips the flexible cover 102 back up over the reel 104 and feeds the cable 110, anchor 112 first, into the gun chamber and down the bore of the gun, as illustrated in FIG. 16. Once the anchor 112 exits the barrel's crown, as illustrated in FIG. 17, the user can take the cable 110, insert it into the anchor site 106, and pull it through the anchor site 106 until the anchor 112 is captured in the anchor site 106, as illustrated in FIG. 18. The user can then pull on the ergonomic handle that is comprised of the flexible cover 102 and reel 104, which will pull the remaining cable 110 and the cleaning tool 114 through the bore of the firearm, as illustrated in FIG. 19. If the bore requires additional cleaning, the user can detach the anchor 112 from the anchor site 106 and repeat the above steps starting with feeding the cable 110 into the gun chamber and down the bore of the gun.

When the user has completed cleaning the bore, the user can detach the anchor 112 from the anchor site 106, flip the flexible cover 102 down (i.e., inside out), insert the cleaning tool 114 into the storage cavity 108, as illustrated in FIG. 20, and wrap the cable 110 back around the reel 104, as illustrated in FIG. 21. If the cleaning tool 114 is too long for the storage cavity 108, a portion of it may also wrap around the reel 104. Once the cable 110 and cleaning tool 114 are in place, the user can flip the flexible cover 104 back up around the wrapped cable 110 and cleaning tool 114. This storage feature provides clean storage for the device by preventing the carbon and other residue from making contact with other items that may be stored in a similar area as the caliber-specific cleaning kit.

In another example of a use case, the flexible cover 102 can slide over the reel 104 instead of fold over, thus exposing the reel 104 and the cable 110, anchor 112, and cleaning tool 114 for use as described above. The flexible cover 102 can, in some embodiments, remain fixed to the reel 104 or, in other embodiments, can slide completely off.

In a further example, the flexible cover 102 can twist and rotate upward to expose the reel 104 and the cable 110, anchor 112, and cleaning tool 114 for use as described above. The flexible cover 102 can, in some embodiments, remain fixed to the reel 104 or, in other embodiments, can slide completely off. Other embodiments are envisioned wherein the flexible cover 102 exposes the reel 104 and the cable 110, anchor 112, and cleaning tool 114 for use as described above.

In addition to, or instead of, using the above-described device as a firearm-cleaning tool, the device could be used as a general cleaning tool for pipes or enclosed spaces having two openings, wherein the anchor 112 and cable 110 could be threaded through the enclosed space and the cleaning tool 114 pulled through to scrape and wipe the surface of the enclosed space clean. Alternatively, the above-described device could be used to create a handle and better gripping surface without necessarily being used as a cleaning device.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

What is claimed is:

1. A gun bore cleaning kit comprising:

a hollow reel defining:

an interior region, and an anchor site comprised of an anchor opening and an exit, wherein the anchor site further defines a main body configured to pass from the anchor opening to the exit;

a grip, structured and configured to approximately bisect the interior region, wherein the grip is positioned across from the anchor site;

a cover configured to move between a first position and a second position in relation to the reel;

a tether;

an anchor connected to the tether and configured to catch at the anchor site; and a cleaning tool connected to the tether.

2. The gun bore cleaning kit of claim 1, wherein the interior region is comprised of a storage region and an internal cavity.

3. The gun bore cleaning kit of claim 1, wherein the grip is structured and configured to define a linear gripping portion to be ergonomically gripped by a human hand.

4. The gun bore cleaning kit of claim 1, wherein, in the first position, the cover encases an outside circumference of the reel and wherein, in the second position, at least a portion of the reel is exposed.

5. The gun bore cleaning kit of claim 1, wherein the reel is a rigid reel.

6. The gun bore cleaning kit of claim 2, wherein the storage region is configured to receive an insert having an external shape that conforms to an internal shape of the storage region.

7. The gun bore cleaning kit of claim 2, wherein the grip is substantially formed by an outer wall of the storage region.

8. The gun bore cleaning kit of claim 1, wherein the anchor site is further comprised of:

an entrance compartment protruding into the interior region from an inner surface of the reel, the entrance compartment having the anchor opening;

wherein:

the exit is comprised of an exterior opening on an external surface of the reel, and the main body connects the exterior opening to the entrance compartment.

9. The gun bore cleaning kit of claim 1, wherein the tether is a flexible, metal cable.

10. The gun bore cleaning kit of claim 8, wherein the anchor is a round ball and has a diameter larger than a width of the exit and smaller than a width of the anchor opening.

11. The gun bore cleaning kit of claim 1, wherein the cleaning tool is comprised of a plurality of cleaning implements.

12. The gun bore cleaning kit of claim 11, wherein the cleaning implements include a brush and a woven bore cleaner.

13. The gun bore cleaning kit of claim 12, wherein the brush is connected on a first end to the tether and on a second end to the woven bore cleaner.

14. The gun bore cleaning kit of claim 13, wherein the woven bore cleaner is attached to the brush via a swivel connection.

15. The gun bore cleaning kit of claim 1, wherein the cover is a rigid cover.

16. The gun bore cleaning kit of claim 15, wherein the rigid cover is configured to removably snap onto and off of the reel.

17. The gun bore cleaning kit of claim 8, wherein:

the main body is comprised of a notch and is structured and configured to continue through the reel;

the notch is continuously open from the entrance compartment, along a bottom face of the lower lip, to the exterior opening; and the anchor opening is on a top face of the entrance compartment.

18. The gun bore cleaning kit of claim 1, wherein the cover is a flexible, circular cover having a top edge and a bottom edge, and the cover is fixedly attached to the reel.

19. The gun bore cleaning kit of claim 18, wherein:

the top edge of the flexible, circular cover is fixedly attached to a top edge of the reel; and the flexible, circular cover is configured to flip inside out and expose the reel.

20. The gun bore cleaning kit of claim 11, where the cleaning tool is comprised of a brush and a mop.

21. The gun bore cleaning kit of claim 20, wherein the mop is a felt mop.

22. The gun bore cleaning kit of claim 20, wherein the mop is a wool mop.

23. The gun bore cleaning kit of claim 20, wherein the mop is a cotton mop.

24. The gun bore cleaning kit of claim 20, wherein the mop is a polyester mop.

25. A storage device comprising:

a hollow reel defining:

an interior region, and an anchor site configured to define a main body that passes from an anchor opening to an exit;

a grip structured and configured to approximately bisect the interior region, wherein the grip is positioned across from the anchor site; and a flexible cover structured and configured to encase an outside circumference of the reel and to flip inside out to expose the reel.

26. The storage device of claim 25, further comprising a cable attached on a first end to an anchor that connects to the storage device and on a second end to a cleaning tool, wherein:

the cleaning tool is arranged in line with the cable.

27. The storage device of claim 13, wherein the anchor site is further comprised of:

an entrance compartment open to the interior region, the entrance compartment having the anchor opening;

wherein:

the exit is comprised of an exterior opening on an external surface of the reel, and the main body connects the exterior opening to the anchor opening.

28. A tool comprising:

a hollow reel comprised of a groove with upper and lower lips, the reel defining:

an interior region, and an anchor site comprised of an anchor opening and an exit, wherein the anchor site further defines a main body configured to pass from the anchor opening to the exit;

a grip structured and configured to approximately bisect the interior region, wherein the grip is positioned across from the anchor site;

a cover having a top edge and a bottom edge, wherein:

the cover is fixedly attached to the reel, and the cover is configured to move between a first position and a second position in relation to the reel;

a tether; and an anchor connected to the tether and configured to catch at the anchor site.

29. The tool of claim 28, wherein:

the anchor opening is an opening into the interior region and the exit is an opening on an external surface of the reel; and the tether is connected to a tool.

30. A gun bore cleaning kit comprising:

a rigid reel comprised of a groove with upper and lower lips, the rigid reel having:

an interior region comprised of an internal cavity and a storage region, and an anchor site comprised of:

an entrance compartment open to the internal cavity from an inner surface of the rigid reel, the entrance compartment having an anchor opening, a main body that continues through the rigid reel, and an exterior opening on an external surface of the rigid reel;

a flexible cover having structured and configured to encase an outside circumference of the rigid reel and to flip inside out to expose the rigid reel;

a cable having a first end and a second end;

an anchor attached to the first end of the cable and sized to fit in the anchor opening; and a cleaning tool attached to the second end of the cable.

31. A gun bore cleaning tool comprising:

a cable;

a woven bore cleaner;

a rigid brush attached on a first end to a first end of the cable and on a second end to the woven bore cleaner;

an anchor attached to a second end of the cable; and a reel, the reel being comprised of:

a groove with upper and lower lips, an interior region, an anchor site comprised of an anchor opening that is open to the interior region, and a grip structured and configured to approximately bisect the interior region and to be positioned across from the anchor site;

wherein the anchor is structured and configured to mate with the reel.

32. The gun bore cleaning tool of claim 31, wherein the woven bore cleaner is attached to the rigid brush via a swivel connection.

33. The gun bore cleaning tool of claim 31, wherein:

the anchor is comprised of a rigid ball;

the interior region is comprised of a hollow cavity and a storage region;

the anchor site is further comprised of:

an entrance compartment protruding into the hollow cavity from an inner surface of the reel, the entrance compartment having walls and a top face, and a main body that connects the anchor opening to an exterior opening on an external surface of the reel, wherein the anchor opening is located on the top face of the entrance compartment;

the storage region is adjacent to the hollow cavity; and a flexible cover has a top edge and a bottom edge, wherein:

the bottom edge of the flexible cover aligns with a bottom face of the reel, the top edge of the flexible cover aligns with a top face of the reel, the top edge of the flexible cover is fixedly attached to a top edge of the reel, the flexible cover, in a first position, is configured to encase an outside circumference of the reel, and the flexible cover is configured to flip inside out into a second position to expose the reel.

* * * * *